US006050429A

United States Patent [19]

Habisohn

[11] Patent Number: 6,050,429

[45] Date of Patent: Apr. 18, 2000

[54] METHOD FOR INCHING A CRANE WITHOUT LOAD SWING

[76] Inventor: Chris X. Habisohn, 1505 Falcon La., Hoffman Estates, Ill. 60192

[21] Appl. No.: 08/985,994

[22] Filed: Dec. 5, 1997

Related U.S. Application Data

[63] Continuation of application No. 08/764,994, Dec. 16, 1996.

[51] Int. Cl.[7] ..... B66C 19/00

[52] U.S. Cl. ..... 212/275; 212/270

[58] Field of Search ..... 212/270, 275

[56] References Cited

U.S. PATENT DOCUMENTS

| | | | |
|---|---|---|---|
| 2,801,351 | 4/1957 | Calvert et al. | 307/149 |
| 3,010,035 | 11/1961 | Calvert et al. | 307/152 |
| 3,517,830 | 6/1970 | Virkkala | 212/132 |
| 3,921,818 | 11/1975 | Yamagishi | 212/132 |
| 4,512,711 | 4/1985 | Ling et al. | 414/786 |
| 4,603,783 | 8/1986 | Tax et al. | 212/132 |
| 4,717,029 | 1/1988 | Yasunobu et al. | 212/132 |
| 4,756,432 | 7/1988 | Kawashima et al. | 212/132 |
| 4,916,635 | 4/1990 | Singer et al. | 364/513 |
| 4,945,294 | 7/1990 | Anderson, Jr. | 318/119 |
| 4,997,095 | 3/1991 | Jones et al. | 212/147 |
| 5,127,533 | 7/1992 | Virkkunen | 212/147 |
| 5,219,420 | 6/1993 | Kiiski et al. | 212/147 |
| 5,296,791 | 3/1994 | Hipp | 318/563 |
| 5,373,460 | 12/1994 | Marks, II | 364/724.01 |
| 5,490,601 | 2/1996 | Heissat et al. | 212/275 |
| 5,526,946 | 6/1996 | Overton | 212/275 |
| 5,529,193 | 6/1996 | Hytonen | 212/275 |
| 5,610,848 | 3/1997 | Fowell | 364/724.07 |
| 5,638,267 | 6/1997 | Singhose et al. | 364/148 |
| 5,819,963 | 10/1998 | Habisohn | 212/275 |
| 5,897,006 | 4/1999 | Habisohn | 212/275 |

FOREIGN PATENT DOCUMENTS 0 433 375 B1 10/1996 European Pat. Off. .

OTHER PUBLICATIONS

Butler et al., "Model Reference Adaptive Control of Gantry Crane Scale Model", IEEE Jan. 1991, pp. 57–62.

Cook, Gerald "Control of Flexible Structures Via Posicast", Dept. of Electrical & Computer Engineering, George Mason University, pp. 31–35 (prior art).

Cook, Gerald "An Application of Half–Cycle Posicast" IEEE Transactions on Automatic Control, Jul. 1966, pp. 556–559.

Cook, Gerald "Posicast Versus Conventional Types of Compensation in a Control System", B.S., Virginia Polytechnic Institute, 1961, 51 pages.

Crain et al., "Evaluation of Input Shaping on Configuration Dependent Systems", vol. 1, ASME Jul. 1996, pp. 315–318.

Dodds et al., "A signed switching time bang–bang attitude control law for fine pointing of flexible spacecraft", Int. J. Control, 1984, vol. 40, No. 4, pp. 795–811.

Dodds et al., "A Dynamics Parameter Invariant Attitude Control System for Flexible Spacecraft", International Conference of Dynamics of Flexible Structures in Space, May 15–18, 1990, pp. 157–181.

(List continued on next page.)

*Primary Examiner*—Thomas J. Brahan

*Attorney, Agent, or Firm*—Marshall, O'Toole, Gerstein, Murray & Borun

[57] ABSTRACT

A method for moving a carriage of a crane a short distance while simultaneously damping the oscillation of its load. The method includes: determining the period of oscillation T of the load; moving the carriage a first displacement from an initial position to a desired final position; moving said carriage a second displacement from the desired final position back to said initial position, a time T/6 after said first displacement; and repeating the first displacement to provide a third displacement from the initial position back to said desired final position, a time T/6 after said second displacement; while causing load oscillations to be damped.

19 Claims, 2 Drawing Sheets

OTHER PUBLICATIONS

Erickson, Bert K., "Input Attenuation Functions Improve Servomechanism Performance", IEEE Transactions on Inductrial Electronics and Control Instrumentation, vol. IECI–18, No. 4, Nov. 1971, pp. 144–156.

Fairfield, R. L., "Designing a Deadbeat Compensating Network", Control Engineering, Aug. 1966, pp. 75–77.

Ford et al., "The Application of Short–Time Memory Devices to Compensator Design", AIEE Winter General Meeting, Jan. 18–22, 1954, pp. 88–93.

Gimpel, et al., "Signal Component Control", AIEE Summer General Meeting Jun. 23–27, 1952, pp. 339–343.

Gorbatenko, George G., "Posicast Control by Delayed Gain", Control Engineering, Feb. 1965, 4 pages.

Horng et al., "Digital Posicast Technique to Second Order Control Systems", Journal of the Chinese Society of Mechanical Engineers, vol. 6, No. 2, pp. 103–106, 1985.

Hyde et al., "Contact Transition Control: An Experimental Study", 1993 IEEE, pp. 363–368.

Hyde et al., "Inhibiting Multiple Mode Vibration in Controlled Flexible Systems", Proceedings of the 1991 American Control Conference, pp. 2449–2454.

Hyde et al., "Controlling Contact Transition", 1994 IEEE, Feb. 1994, pp. 25–30.

Jones et al., "Control Input Shaping for Coordinate Measuring Machines", American Control Conference 1994, pp. 2899–2903.

Jones et al., "Swing Damped Movement of Suspended Objects", Sandia Report, Sep. 1990, pp. i–ii and 1–34.

Kallmann, Heinz E., "Transversal Filters", Proceedings of the I.R.E. Jul. 1940, pp. 302–310.

Kreisselmeier et al., "Application of Vector Performance Optimization to a Robust Control Loop Design for a Fighter Aircraft", 1980, pp. 1–69.

Magee et al., "The Application of Input Shaping to A System With Varying Parameters", Japan/USA Symposium on Flexible Automation—vol. 1, ASME 1992, pp. 519–526.

Magee et al., "Eliminating Multiple Modes of Vibration in a Flexible Manipulator", 1993 IEEE, pp. 474–479.

Magee et al., "Filtering Schilling Manipulator Commands to Prevent Flexible Structure Vibration", Proceedings of the American Control Conference, Jun. 1994, pp. 2538–2542.

Magee et al., "Implementing Modified Command Filtering to Eliminate Multiple Modes of Vibration", Proceedings of the American Control Conference, Jun. 1993, pp. 2700–2704.

Mee, D. H., "A Feedback Implementation of Posicast Control Using Sampling Circuits", Proceedings of the IREE, Jan./Feb. 1974, pp. 11–15.

Ohnishi et al., "Automatic Control Of An Overhead Crane", IFAC Control Science and Technology, 1981, pp. 1885–1890.

Sakawa et al., "Optimal Control of Container Cranes", Automatics, vol. 18, No. 3, pp. 257–266, 1982.

Sato et al., "Modelling and control of a flexible rotary crane", Int. J. Control, 1988, vol. 48, No. 5, pp. 2085–2105.

Singh et al., "Robust Time–Optimal Control: Frequency Domain Approach", Journal of Guidance, Control, and Dynamics, vol. 17, No. 2, Mar.–Apr. 1994, pp. 346–353.

Singhose et al., "Input Shaping for Vibration Reduction With Specified Insensitivity to Modeling Errors", Japan/USA Symposium on Flexible Automation, vol. 1, ASME Jul. 1996, pp. 307–313.

Singhose et al., "Extra–Insensitive Input Shapers for Controlling Flexible Spacecraft", Journal of Guidance, Control, and Dynamics, vol. 19, No. 2, Mar.–Apr. 1996, pp. 385–391.

Singhose et al., "Effects of Input Shaping on Two–Dimensional Trajectory Following", IEEE Transactions on Robotics and Automation, vol. 12, No. 6, Dec. 1996, pp. 881–887.

Singhose et al., "Input Shapers for Improving the Throughput of Torque–Limited Systems", 1994 IEEE, pp. 1517–1522.

Singhose et al., "Design and Implementation of Time–Optimal Negative Input Shapers", DSC—vol. 55–1, Dynamic Systems and Control: vol. 1, ASME 1994, pp. 151–157.

Smith, Otto J. M., "Posicast Control of Damped Oscillatory Systems", Proceedings of the IRE, Jun. 1957, pp. 1249–1255.

Smith, Otto J. M., "Feedback Control Systems", McGraw–Hill Book Company, Inc., 1958, pp. 329–345.

So et al., "A Modified Posicast Method of Control With Applications to Higher–Order Systems", Nov. 1960, pp. 320–326.

Starr, G. P., "Swing–Free Transport of Suspended Objects With a Path–Controlled Robot Manipulator", Journal of Dynamics Systems, Measurement and Control, Technical Briefs, 1985, 5 pages.

Sze et al., "Short–Time Memory Devices in Closed–Loop Systems—Steady–State Response", AIEE Fall General Meeting, Oct. 3–7, 1955, pp. 340–344.

Tuttle et al., "A Zero–placement Technique for Designing Shaped Inputs to Suppress Multiple–mode Vibration", Proceedings of the American Control Conference, Jun. 1994, pp. 2533–2537.

Yu et al., "Fault Diagnosis for a Gas–Fired Furnace Using Bilinear Observer Method", Proceedings of the American Control Conference, Jun. 1995, pp. 1127–1131.

Convolve, Inc. document entitled "New Control Strategy Eliminates Residual Vibrations", Oct. 1994, 2 pages.

D. M. Aspinwall, "Acceleration Profiles for Minimizing Residual Response", Journal of Dynamic Systems, Measurement and Control, Mar. 1980, vol. 102/3, 4 pages.

Auernig et al., "Time Optimal Control of Overhead Cranes with Hoisting of the Load", Automatica, vol. 23, No. 4, pp. 437–447, 1987.

Farrenkopf, "Optimal Open–Loop Maneuver Profiles for Flexible Spacecraft", J. Guidance and Control, vol. 2, No. 6, Article No. 78–1280R, Nov.–Dec. 1979, pp. 491–498.

Narendra K. Gupta, "Frequency–Shaped Cost Functionals: Extension of Linear–Quadratic–Gaussian Design Methods", American Institute of Aeronautics and Astronautics, Inc., 1989, 7 pages.

Hyde et al., "Using Input Command Pre–Shaping to Suppress Multiple Mode Vibration", Proceedings of the 1991 IEEE International Conference on Robotics and Automation, Apr. 1991, pp. 2604–2609.

Jones et al., "Oscillation Damped Movement of Susptended Objects", 1988 IEEE Bulletin, pp. 956–962.

Juang et al., "Closed–Form Solutions for Feedback Control with Terminal Constraints", J. Guidance, American Institute of Aeronautics and Astronautics, Inc. vol. 8, No. 1, Jan.–Feb. 1985, pp. 39–41.

Kim et al., "Control of Induction Motors for Both high Dynamic Performance and High Power Efficiency", IEEE Transactions On Industrial Electronics, vol. 39, No. 4, Aug. 1992, pp. 323–333.

Kress et al., "Experimental Implementation of a Robust Damped–Oscillation Control Algorithm On a Full–Sized, Two–Degree–Of–Freedom, AC Induction Motor–Driven Crane", 3 pages, published Aug. 1994.
Kress et al., "Experimental Implementation of a Robust Damped–Oscillation Control Algorithm On a Full–Sized, Two–Degree–Of–Freedom, AC Induction Motor–Driven Crane", 8 pages, published Aug. 1994.
Marttinen et al., "Modelling and analysis of a trolley crane", Proceedings of the Intern. AMSE Conference "Modelling & Simulation", Pomona, California, Dec. 16–18, 1987, vol. 3, p 15–26.
Arto Marttinen, "Pole–Placement Control of a Pilot Gantry", 3 pages, 1989.
Meckl et al., "Feedforward Control Techniques to Achieve Fast Settling Time in Robots", pp. 1913–1918, 1986.
Meckl et al., "Minimizing Residual Vibration for Point–to–Point Motion", Transactions of the ASME, vol. 107, Oct. 1985, pp. 378–382.
Meckl et al., "Reducing Residual Vibration In Systems With Time–Varying Resonances", 1987 IEEE, pp. 1690–1695.
Moustafa et al., "Nonlinear Modeling and Control of Overhead Crane Load Sway", Journal of Dynamic Systems, Measurement and Control, Transactions of the ASME, vol. 110, Sep. 1988, pp. 266–271.
Murphy et al., "Digital Shaping Filters for Reducing Machine Vibration", 1992 IEEE, 5 pages.
Noakes et al., "An Applications Of Oscillation Damped Motion for Suspended Payloads to the Advanced Integrated Maintenance System", pp. 63–67, published Aug. 1994.
Noakes et al., "Generalized inputs for damped–vibration control of suspended payloads", Robotics and Autonomous Systems 10, 1992, pp. 199–205.
Noakes et al., "Implementation of Damped–Oscillation Crane Control for Existing AC Induction Motor–Driven Cranes", pp. 479–485, published Aug. 1994.
Noakes et al., "Shaping Inputs To Reduce Vibration For Suspended Payloads", pp. 141–150, published Aug. 1994.
Petterson et al., "Parameter–Scheduled Trajectory Planning for Suppression of Coupled Horizontal and Vertical Vibrations in a Flexible Rod", pp. 916–920, 1990.
A. J. Ridout, "New Feedback Control System for Overhead Cranes", Electric Energy Conference, Oct. 1987, pp. 135–140.
Otto J. M. Smith, "Feedback Control Systems" book, McGraw–Hill Series in Control Systems Engineering, pp. 331–340, 1958.
Riku Salminen, "Towards Industrial Crane Computer Control", Helsinki University of Technology, Chapters 7 through 10, pp. 33–74, May 1991.
Sehitoglu et al., "Design of a Trajectory Controller for Industrial Robots Using Bang–Bang and Cycloidal Motion Profiles", pp. 169–175, 1986.
Singer et al., "Design and Comparison of Command Shaping Methods for Controlling Residual Vibration", 1989 IEEE, pp. 888–893.
Singer et al., "An Extension of Command Shaping Methods for Controlling Residual Vibration Using Frequency Sampling", Proceedings of the 1992 IEEE International Conference on Robotics and Automation, pp. 800–805.
Singer et al., "An Input Shaping Controller Enabling Cranes to Move Without Sway", pp. 225–231, May 1997.
Singer et al., "Preshaping Command Inputs to Reduce System Vibration", Tranactions of the ASME, Journal of Dynamic Systems, Measurement, and Control, vol. 112, Mar. 1990, 6 pages.
Singer et al., "Preshaping Command Inputs to Reduce System Vibration", Massachusetts Institute of Technology, Jan. 1988, 24 pages.
Neil C. Singer, "Residual Vibration Reduction in Computer Controlled Machines", Technical Report 1030, Feb. 1989, pp. 1–227.
Singer et al., "Using Acausal Shaping Techniques to Reduce Robot Vibration", 1988 IEEE, pp. 1434–1439.
Singhose et al., "Shaping Inputs to Reduce Vibration: a Vector Diagram Approach", 1990 IEEE, pp. 922–927.
William Singhose, "Shaping Inputs to Reduce Vibration: A Vector Diagram Approach", Massachusetts Institute of Technology, Mar. 1990, pp. 3–53.
C. J. Swigert, "Shaped Torque Techniques", J. Guidance and Control, vol. 3, Sep.–Oct. 1980, pp. 460–467.
Virkkunen et al., "Computer Control Of A Loading Bridge", IEE International Conference, Apr. 1988, 6 pages.
Wang et al., "Open–Loop Control Of A Flexible Robot Manipulator", International Journal of Robotics and Automation, vol. 1, No. 2, 1986, pp. 54–57.
Yoon et al., "Development of Anti–Swing Control Algorithm for the Overhead Crane", Remote Technology Section, Spent Fuel Management Division, Korea Atomic Energy Research Institute, 14 pages, published Aug. 1994.

METHOD FOR INCHING A CRANE WITHOUT LOAD SWING

This is a continuation of U.S. Ser. No. 08/764,994 filed Dec. 16, 1996, which is incorporated herein by reference.

FIELD OF THE INVENTION

The present invention relates generally to a method for dampening oscillations of a load supported by a crane. More particularly, the invention relates to an open loop method for shaping the speed signal controlling the horizontal motion of a crane to dampen load oscillations when inching or moving the crane a short distance.

STATE OF THE ART

Suspension cranes are used to support and transport loads suspended by a variable length rope hoist. The hoist is attached to a carriage which is traversed along a track. It is desirable to reduce oscillation of the load when it is moved by the crane. Variable speed motor drives on cranes allow very fine and smooth control of the carriage on its traversing run. A traversing run is the travel of the carriage from a beginning rest position to an end rest position. Present methods of damping load oscillations have focused on generating a drive signal that, when applied to the input of the motor drive controlling the horizontal travel of the carriage of the crane, will reduce load swing.

A load oscillation dampener is that part of the control system that shapes the drive signal in a manner that minimizes the swing of the load. Certain known closed loop damping methods use feedback from the angular deviation of the hoisting rope from rest. In these closed loop methods, the signal corresponding to the magnitude of the deviation of the rope suspending the load from vertical is fed back into a load oscillation dampener. The dampener adjusts the speed signal sent to the motor controlling the horizontal motion of the crane in a manner that will dampen the load. U.S. Pat. No. 5,219,420 by Kiiski and Mailisto, 1993, proposes such a method.

Other known damping methods include open loop controls which do not use angular deviation feedback from the rope. However, open loop methods are limited to insuring that the load will not be oscillating or have minimal swing after a transition from one constant speed to another constant speed provided that the load was initially not swinging. Open loop damping presumes that no other forces, except gravity and the carriage motor force are acting on the load. In particular, if the load is not swinging at the beginning of a carriage run then it will not be swinging at the end of the run.

In a conventional open loop technique for load damping, the acceleration rate is fixed. The period of load oscillation is determined. A request for a change in speed results in computing an acceleration time that will provide for half the requested speed change at the fixed acceleration rate. The fixed acceleration rate is applied to the motor for the determined acceleration time to provide half of the requested speed change; and then followed by an equal interval of acceleration one-half period later to complete the requested speed change. Accelerations applied in this manner dampen load swing.

A common feature to all electronic load oscillation damping methods is that changes in speed commands cannot be instantly compensated. A certain settling time must elapse before speed changes are entirely compensated. The load oscillation dampener must spread out the carriage accelerations over time to dampen oscillations. This produces a rather awkward and uncontrolled motion when the crane operator is trying to inch the crane, that is, move the crane a short distance. Once the operator has taken his or her finger off the energizing control button to stop the crane, uncontrolled or erratic damping movements usually continue for a time. The existence of these uncontrolled damping movements makes it difficult for the operator to judge the final distance the crane will travel. Some operators accept this uncontrolled carriage motion, and do their best to anticipate the final displacement of the crane. Others prefer to deactivate the load oscillation dampener during inching with an on-off switch, and thereby avoiding the erratic damping movements.

OBJECTS OF THE INVENTION

A primary object of the invention is to provide a method for inching a crane that responds intuitively and fast to operator inching commands and simultaneously dampens load oscillations.

Another object is to provide a method for inching a crane utilizing an open loop means for damping load swing.

SUMMARY OF THE INVENTION

These objects and others are accomplished by the present invention, which is a method for damping oscillations of a load suspended by a hoisting rope from a carriage moveable along a track, as the carriage is inched from an initial position to a desired final position. The carriage is powered by a carriage motor controlled by a motor drive that is responsive to a drive signal. The period of load oscillation T is determined and the drive signal comprising three parts is generated and applied to the motor drive to cause carriage movement.

The first part of the drive signal causes a carriage displacement as desired by the crane operator. The second part of the drive signal produces a carriage displacement opposite to that of the first part and is generated at a time T/6 after the initiation of the first part of the drive signal. This causes the carriage to back up and return to its initial position. Finally, the third part of the drive signal is generated and applied to the motor drive. The third part of the drive signal is the same as the first part of the drive signal but delayed by a time T/3 after the initiation of the first part, causing the carriage to return to the desired final position. Carriage motion of this type—a first motion, followed by an opposite second motion T/6 later, and then followed by a third motion, the same as the first motion, but delayed by T/3 after the first motion, will dampen load oscillations.

In a preferred embodiment of the invention, the first part of the drive signal is generated in response to operator inching commands, such as pushing the forward directional button on a push button control pendant, and then releasing the forward button when the final destination is reached, causing the first part of the drive signal to end. The second and third parts of the drive signal are generated automatically to dampen load oscillations while causing no further net displacement. Hence, the operator has an intuitive feel for positioning the carriage of the crane because the final destination of the carriage is close to the location of the carriage when the operator released the forward button.

An advantage of the present invention for inching the crane is that the sequence of motions will be executed even faster than the motions associated with the aforementioned conventional open loop damping method, where two equal acceleration sequences are applied to the carriage a time T/2 apart. In comparison, the time to complete the inching sequence of the present invention is T/3 plus the duration of the first part of the drive signal, while the aforementioned conventional open loop damping method would take T/2 plus the duration of its first acceleration sequence.

BRIEF DESCRIPTION OF THE DRAWINGS

The present invention may be better understood with reference to the detailed description in conjunction with the following figures where the same reference numbers are employed to indicate corresponding identical elements.

DESCRIPTION OF THE PREFERRED EMBODIMENT

Figure 1:
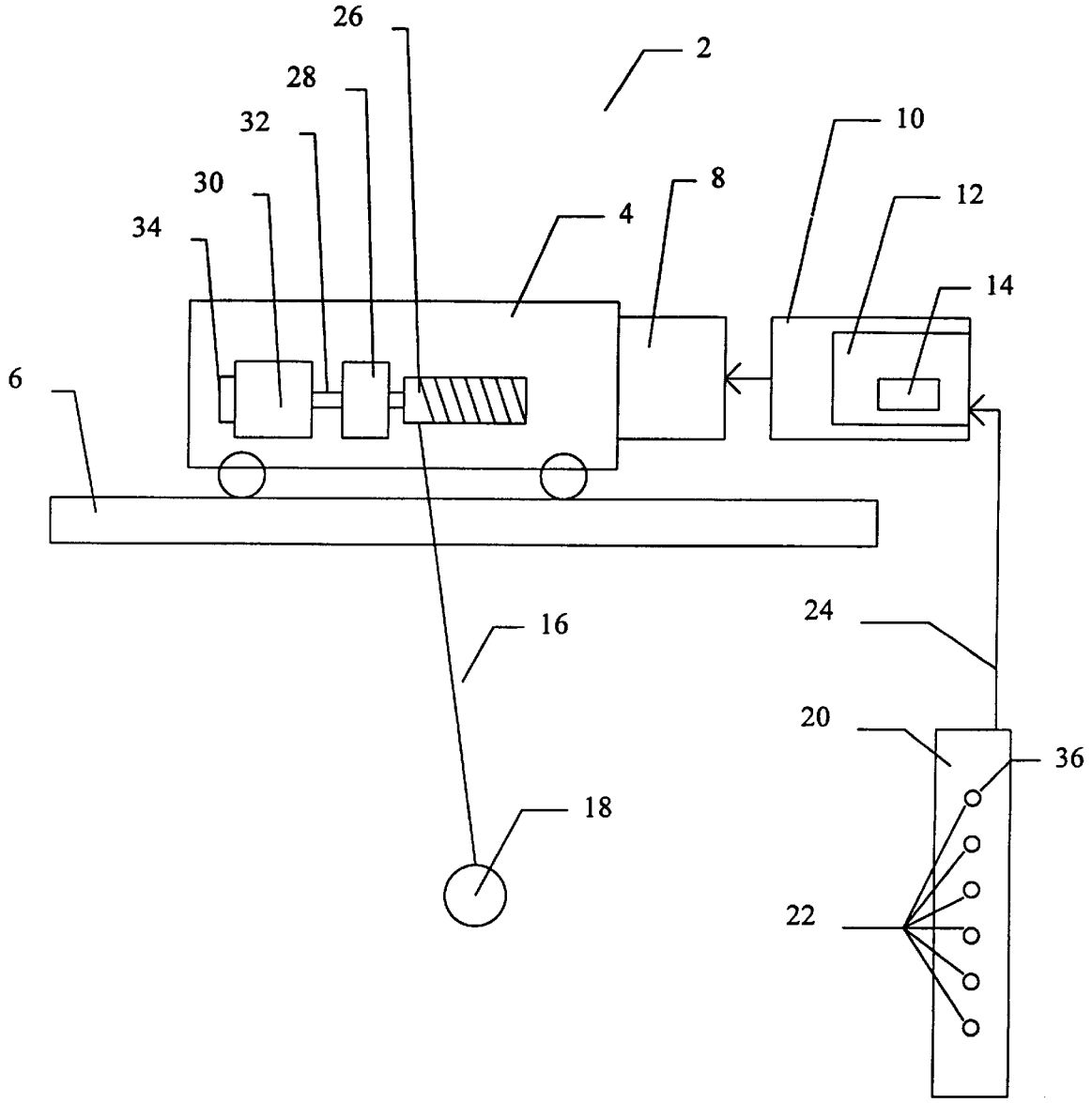
FIG. 1 is a block diagram of a crane system which includes a crane bridge or trolley carriage driven horizontally from one location to another along a track.

FIG. 1 is a block diagram of a crane system 2 which includes a crane bridge or trolley carriage 4 driven horizontally from one location to another along a track 6. The traversing movement of the carriage 4 is powered by a carriage motor 8 which is controlled by a motor drive 10. The motor drive 10 receives a drive signal from a motion controller 12.

In this preferred embodiment, the carriage motor 8 is a three phase squirrel cage induction motor, the motor drive 10 may be a variable frequency drive, and the motion controller 12 may be embedded or included in the electronic logic of the drive 10.

The motion controller 12 contains a load oscillation dampener 14. The load oscillation dampener 14 shapes the drive signal to move the carriage 4 and simultaneously prevents swinging of a hoisting rope 16 and a load 18 connected to the hoisting rope 16.

A motion selector 20 is used by the crane operator to control the desired motion of the carriage 4 along the track 6. Generally, an operator inputs a desired motion such as a direction (forward or reverse) and a desired speed to the motion selector 20 through a push button arrangement 22. The motion selector 20 is connected to the motion controller 12 via a cable 24. The selector 20 and cable 24 may be referred to as a push button pendant. However more complex variable speed selection arrangements than the push button pendant may be used.

Within the carriage 4, the hoisting rope 16 is wound around a rotatable hoisting drum 26 that is coupled to a gear box 28 which is coupled to the hoisting motor 30 through the hoisting motor shaft 32. A shaft encoder 34 is mounted on the other end of the hoisting motor 30 and coupled to its shaft 32 to count the number of turns the shaft 32 makes. The information from the shaft encoder is fed back to the load oscillation dampener 14 and is used to compute the instant length of the hoisting rope 16 from which the period of oscillation of the load may be computed.

Figures 2A, 2B:
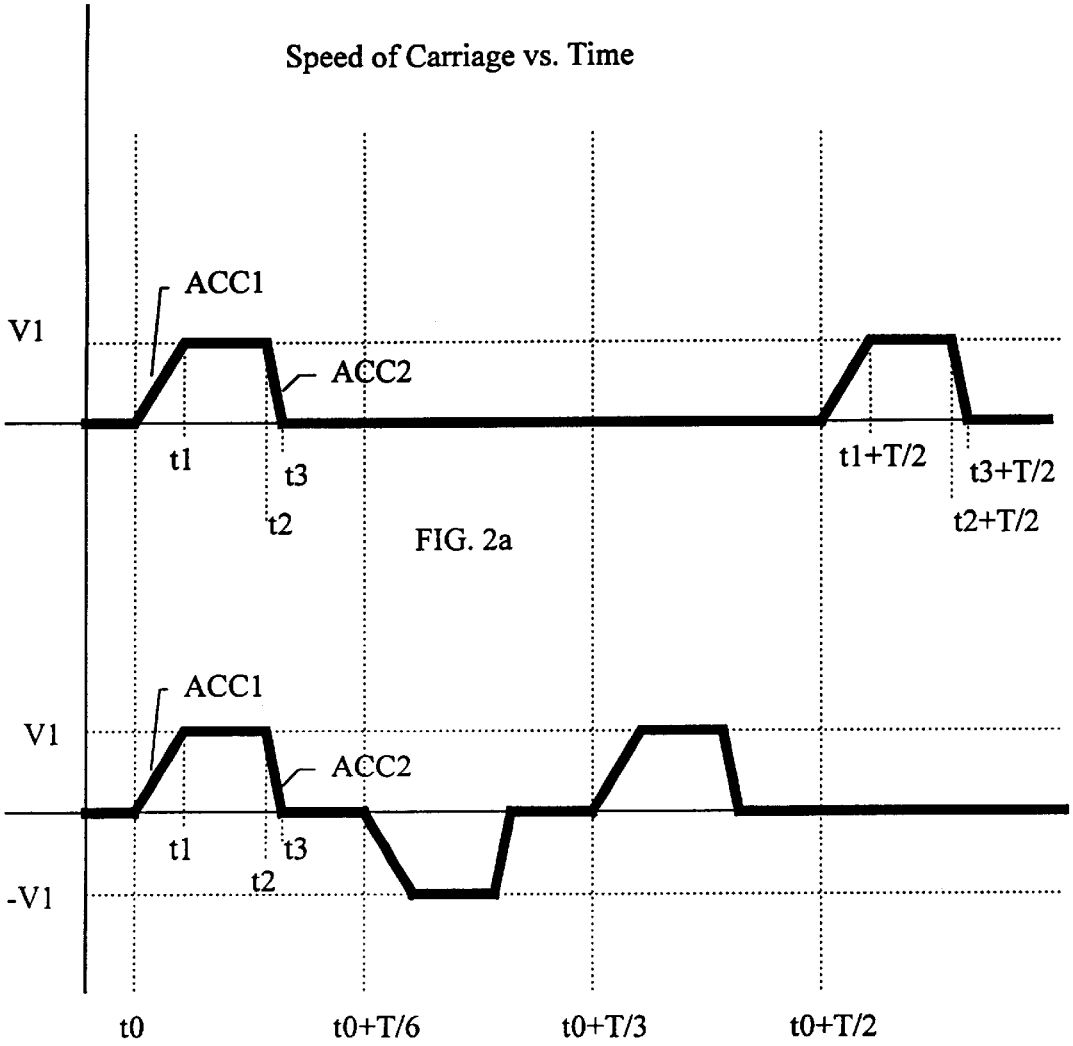
FIG. 2*a* is a graph of the speed of the carriage vs. time which would result if the operator inched the carriage using the aforementioned conventional open loop method for damping load swing.
FIG. 2*b* is a graph of the speed of the carriage 4 vs. time which would result if carriage was inched using the method of the present invention for damping the load swing.

FIG. 2*a* is a graph of the speed of the carriage 4 vs. time which would result if the operator inched the carriage 4 while the load oscillation dampener 14 operates on the aforementioned conventional open loop principle that load oscillation can be damped by applying an acceleration interval followed by an equal acceleration, one-half period later. The operator begins the inching procedure at time t0 by issuing an initial motion command for the carriage 4 in a certain direction. The operator issues the initial motion command, for example, by pressing a pendant button 36. At time t0, the carriage begins to accelerate at a predetermined acceleration rate, ACC1, to reach the speed V1 which is attained at time t1. The acceleration rate ACC1 is indicated by the slope of the graph between times t0 and t1. At time t2, the carriage 4 nears the desired final destination and the operator removes his or her finger from the pendant button 36 causing the carriage 4 to decelerate to a stop at time t3 with an acceleration rate of ACC2.

In the graph in FIG. 2*a*, the acceleration rate, ACC2, used to decelerate the carriage to a stop is faster than the acceleration rate ACC1, used to accelerate the carriage toward V1. To cause load oscillations to be damped, the load oscillation dampener 14 must automatically issue accelerations and decelerations similar to those between t0 and t3 one-half period of oscillation later. Hence, the so called uncontrolled motions between t0+T/2 and t3+T/2 appear, where T represents the period of oscillation of the load. These extra uncontrolled motions cause the carriage to move twice as far as intended by the crane operator and, therefore, overshoot the intended destination or stop point. In the example above for describing the operation of FIG. 2*a* above, the load oscillation period T could either be programmed into the load oscillation dampener 14 as a preset constant, or it could be dynamically determined using a rope length sensor such as the one described above using the shaft encoder 34. The period of oscillation is determined from the measured rope length using the physical relation that period is proportional to the square root of the rope length. For a forty foot rope length, the period of oscillation T is about 7 seconds, which could be derived from the formula $T=2\pi\sqrt{L/g}$, where L is the length in feet from the point of suspension of the hoisting rope to the center of mass of the load, and g is 32.2ft/sec$^2$.

FIG. 2*b* is a graph of the speed of the carriage 4 vs. time which would result if carriage 4 was inched using the method of the present invention. As in the prior inching mode described above, the operator begins the inching procedure at time t0 by issuing an initial motion command, for example, by depressing the pendant button 36 to cause the carriage 4 to attain a speed of V1 in a certain direction. This initial motion command is received by the motion controller 12. In response, the motion controller 12 generates a drive signal which, in this embodiment, is a speed reference signal v(t). The speed reference signal v(t) is coupled to the motor drive 10. The motor drive 10 powers the carriage motor 8 so that the carriage 4 will travel at the speed indicated by the speed reference signal v(t). At time t0, the motion controller 12 begins increasing the magnitude of the speed reference signal at the rate determined by ACC1. The speed of V1 is attained at time t1. At time t2, the carriage 4 nears the desired final destination and the operator removes his or her finger from the pendant button 36 causing the motion controller to decrease magnitude of the speed reference signal toward zero to decelerate the carriage 4 to a stop at time t3.

As in the example described above pertaining to the prior method for load damping, the acceleration rate ACC2 used to decelerate the carriage to a stop is faster than the acceleration rate, ACC1, used to accelerate the carriage toward V1.

The first part of the speed reference signal v(t) is between times t0 and t3. This first part of the speed reference signal v(t) is directly generated from operator commands and is, therefore, natural and intuitive and contains no uncontrolled motions.

According to the present inventive method to cause load oscillations to be damped, the load oscillation dampener 14 automatically generates a second and a third part of the speed reference signal v(t). The second part of the speed reference signal v(t) is the opposite of the first part of the speed reference signal v(t), but delayed by a time T/6 where T represents the period of oscillation of the load suspended from the hoist rope 16. Specifically, the value of the speed reference signal v(t) for times between t0+T/6 and t0+T/3 is −v(t−T/6). The third part of the speed reference signal is to be the same as the first of the speed reference signal but delayed by T/3 after the first part of the speed reference signal. Specifically, the value of the speed reference signal v(t) for times between t0+T/3 and t0+T/2 is V(t−T/3) By adding these second and third parts to the speed reference signal, load oscillations will be damped.

Furthermore, the net displacement produced by the second and third parts is zero. Hence the final carriage 4 destination is that displacement which was achieved at the end of the first part of the speed reference signal. The carriage 4 velocity profile depicted in FIG. 2*b* shows the effect of the second and third parts. The second part of the speed reference signal is shown by the negative velocities between t0+T/6 and t3+T/6, while the third part of the speed reference signal is shown by the positive velocities between t0+T/3 and t3+T/3.

For a forty foot rope T/6 would be about 1.16 seconds. If an operator wanted, for example, to inch the carriage 4 two inches forward from an initial position, the operator would press the pendant button until the carriage 4 moved two inches forward to its final position. Then 1.16 seconds later, the load oscillation dampener 14 would move the carriage 4 two inches back to its initial position. Finally, 1.16 seconds after that (after moving the carriage back to its initial position), the load oscillation dampener 14 would move the carriage 4 two inches forward to its final position, and simultaneously causing damping of the load.

The above described embodiment is merely illustrative of the principles of this invention. Other arrangements and advantages may be devised by those skilled in the art without departing from the spirit and scope of the claims which follow.

I claim:

1. A method of moving the carriage of a crane supporting a load from an initial position to a desired final position while causing damping of said load, said load being suspended by a hoisting rope, said method including the steps of:

(a) determining the period of oscillation T of said load;

(b) moving said carriage a first displacement from said initial position to said desired final position;

(c) moving said carriage a second displacement, said second displacement being in a direction opposite said first displacement and initiated at a time T/6 after initiation of said first displacement to bring said carriage back to said initial position; and (d) moving said carriage a third displacement, said third displacement being in the same direction as said first displacement and initiated at a time T/3 after initiation of said first displacement to bring said carriage back to said desired final position while causing load oscillations to be damped.

2. A method according to claim 1 wherein T is determined from at least one preset constant.

3. A method according to claim 1 wherein T is determined from a rope length sensor.

4. A method of moving the carriage of a crane supporting a load from an initial position to a desired final position while causing damping of said load, said load being suspended by a hoisting rope, said carriage being driven by a motor means responsive to a drive signal, said method including the steps of:

(a) determining the period of oscillation T of said load;

(b) generating a first part of said drive signal for causing movement of said carriage from said initial position to said desired final position;

(c) generating a second part of said drive signal for causing carriage motion in a direction opposite to that caused by said first part of said drive signal to bring said carriage back to said initial position, said second part being delayed by a time T/6 after initiation of said first part;

(d) generating a third part of said drive signal for causing carriage motion in the same direction as that caused by said first part of said drive signal to bring said carriage back to said desired final position, said third part being delayed by a time T/3 after initiation of said first part; and (e) applying said drive signal to said motor means to cause said load to be moved and load oscillations to be damped.

5. A method of moving the carriage of a crane supporting a load from an initial position to a desired final position while causing damping of said load, said load being suspended by a hoisting rope, said method including the steps of:

(a) determining the period of oscillation T of said load;

(b) commencing a first movement of said carriage at said initial position in a first direction;

(c) moving said carriage a first displacement from said initial position to said final position;

(d) commencing a second movement of said carriage at said final position in a direction opposite said first direction at a time T/6 after commencing said first movement;

(e) moving said carriage a second displacement from said final position back to said initial position;

(f) commencing a third movement of said carriage in said first direction at said initial position at a time T/3 after commencing said first movement; and (g) moving said carriage a third displacement from said initial position back to said final position to cause damping of load oscillations.

6. A method of moving the carriage of a crane supporting a load from an initial position to a desired final position while causing damping of said load, said load being suspended by a hoisting rope, said carriage being driven by a motor means responsive to a drive signal, said method including the steps of:

(a) determining the period of oscillation T of said load;

(b) generating a first part of said drive signal;

(c) applying said first part of said drive signal to said motor means to cause movement of said carriage from said initial position to said final position;

(d) generating a second part of said drive signal;

(e) applying said second part of said drive signal to said motor means delayed by a time T/6 after initially applying said first part of said drive signal to said motor means to cause movement of said carriage from said final position back to said initial position;

(f) generating a third part of said drive signal; and (g) applying said third part of said drive signal to said motor means delayed by a time T/3 after initially applying said first part of said drive signal to said motor means to cause movement of said carriage from said initial position back to said final position and simultaneously damping oscillations of said load.

7. A method according to claim 6 additionally including the step of:

determining the length of said hoisting rope susceptible to oscillate as said carriage moves horizontally from said initial position to said final position.

8. A method according to claim 6 additionally including the step of:

externally providing a signal to cause generation of said first part of said drive signal for initially moving said carriage from said initial position to said final position, said second part and said third part of said drive signal being automatically formed in response to said generation of said first part of said drive signal.

9. An apparatus for controlling the operation of a crane from which a load is suspended by a hoisting rope attached to a carriage, said load having a period of oscillation T, said carriage being driven by a motor from an initial position to a final position, said apparatus comprising:

a motor drive for causing said motor to drive said carriage; and a controller coupled to said motor drive for causing said carriage to be driven by said motor, said controller causing said carriage to be moved a first displacement from said initial position to said final position, said controller causing said carriage to be moved a second displacement from said final position back to said initial position in a direction opposite said first displacement, said second displacement being commenced at a time T/6 after initiation of said first displacement, and said controller causing said carriage to be moved a third displacement from said initial position back to said final position in the same direction as said first displacement, said third displacement being commenced at a time T/3 after initiation of said first displacement.

10. An apparatus according to claim 9 wherein T is determined from at least one preset constant.

11. An apparatus according to claim 9 additionally comprising a rope length sensor for determining said period of oscillation T.

12. An apparatus for controlling the operation of a crane from which a load is suspended by a hoisting rope attached to a carriage, said load having a period of oscillation T, said carriage being driven by a motor from an initial position to a final position, said apparatus comprising:

a motor drive for causing said motor to drive said carriage; and a controller coupled to said motor drive for causing said carriage to be driven by said motor, said controller generating a first part of a drive signal for causing said carriage to be moved a first displacement from said initial position to said final position, said controller generating a second part of said drive signal for causing said carriage to be moved a second displacement from said final position back to said initial position in a direction opposite said first displacement, said second part being delayed by a time T/6 after said first part, said controller generating a third part of said drive signal for causing said carriage to be moved a third displacement from said initial position back to said final position in the same direction as said first displacement, said third part being delayed by a time T/3 after said first part, said controller causing said drive signal to be applied to cause said carriage to be moved in through said displacements and load oscillations to be damped.

13. An apparatus according to claim 12 wherein T is determined from at least one preset constant.

14. An apparatus according to claim 12 additionally comprising a rope length sensor for determining said period of oscillation T.

15. An apparatus for controlling the operation of a crane from which a load is suspended by a hoisting rope attached to a carriage, said load having a period of oscillation T, said carriage being driven by a motor from an initial position to a final position, said apparatus comprising:

a motor drive for causing said motor to drive said carriage; and a controller coupled to said motor drive for causing said carriage to be driven by said motor, said controller generating a first part of a drive signal and applying said first part of said drive signal to cause said carriage to be moved a first displacement from said initial position to said final position, said controller generating a second part of said drive signal and applying said second part of said drive signal to cause said carriage to be moved a second displacement from said final position back to said initial position in a direction opposite said first displacement, said second displacement being commenced at a time T/6 after initiation of said first displacement, said controller generating a third part of said drive signal and applying said third part of said drive signal to cause said carriage to be moved a third displacement from said initial position back to said final position in the same direction as said first displacement, said third displacement being commenced at a time T/3 after initiation of said first displacement.

16. An apparatus according to claim 15 wherein T is determined from at least one preset constant.

17. An apparatus according to claim 15 additionally comprising a rope length sensor for determining said period of oscillation T.

18. An apparatus according to claim 15 wherein said controller additionally determines the length of said hoisting rope susceptible to oscillate as said carriage moves horizontally from said initial position to said final position.

19. An apparatus according to claim 15 wherein said controller additionally provides a signal to cause generation of said first part of said drive signal for initially moving said carriage from said initial position to said final position, said second part and said third part of said drive signal being automatically formed in response to said generation of said first part of said drive signal.

* * * * *